US007447629B2

(12) United States Patent
Breebaart

(10) Patent No.: US 7,447,629 B2
(45) Date of Patent: Nov. 4, 2008

(54) AUDIO CODING

(75) Inventor: Dirk Jeroen Breebaart, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 663 days.

(21) Appl. No.: 10/520,307

(22) PCT Filed: Jun. 19, 2003

(86) PCT No.: PCT/IB03/02858

§ 371 (c)(1),
(2), (4) Date: Jan. 5, 2005

(87) PCT Pub. No.: WO2004/008805

PCT Pub. Date: Jan. 22, 2004

(65) Prior Publication Data

US 2006/0206323 A1 Sep. 14, 2006

(30) Foreign Application Priority Data

Jul. 12, 2002 (EP) ..... 02077866

(51) Int. Cl.
*G10L 21/00* (2006.01)

(52) U.S. Cl. ..... 704/219; 704/500; 381/2; 381/307

(58) Field of Classification Search ..... 704/219, 704/500; 381/2, 307
See application file for complete search history.

(56) References Cited

U.S. PATENT DOCUMENTS 3,204,110 A 8/1965 Masuda
3,250,140 A 5/1966 Russel
3,750,386 A 8/1973 Harting
4,110,630 A 8/1978 Hendel
4,260,901 A 4/1981 Woodridge
4,317,047 A 2/1982 de Almada
4,423,334 A 12/1983 Jacobi et al.
4,580,400 A 4/1986 Watabe et al.
4,700,817 A 10/1987 Kondo et al.
5,271,328 A 12/1993 Boulais et al.
5,460,099 A 10/1995 Matsuhisa et al.
5,552,657 A 9/1996 Epstein et al.
5,812,971 A 9/1998 Herre
5,870,480 A * 2/1999 Griesinger ..... 381/18
5,941,692 A 8/1999 Olney et al.

(Continued)

FOREIGN PATENT DOCUMENTS

EP 0618380 A1 10/1994

(Continued)

*Primary Examiner*—Daniel D Abebe

(57) ABSTRACT

A method of encoding a multi-channel audio signal including at least a first signal component (LF), a second signal component (LR) and a third signal component (RF). The method comprises the steps of encoding the first and second signal components by a first parametric encoder (202) resulting in a first encoded signal (L) and a first set of encoding parameters (P2); encoding the first encoded signal and a further signal (R) by a second parametric encoder (201), resulting in a second encoded signal (T) and a second set of encoding parameters (P1), where the further signal is derived from at least the third signal component; and representing the multi-channel audio signal at least by a resulting encoded signal (T) derived from at least the second encoded signal, by the first set of encoding parameters and by the second set of encoding parameters.

13 Claims, 6 Drawing Sheets

U.S. PATENT DOCUMENTS

| | | | | |
|---|---|---|---|---|
| 6,023,490 | A * | 2/2000 | Ten Kate | 375/240 |
| 6,332,119 | B1 | 12/2001 | Hinderks | |
| 6,650,755 | B2 * | 11/2003 | Vaudrey et al. | 381/18 |
| 7,231,054 | B1 * | 6/2007 | Jot et al. | 381/310 |
| 2002/0036707 | A1 | 3/2002 | Gu | |
| 2003/0125933 | A1 * | 7/2003 | Saunders et al. | 704/201 |

FOREIGN PATENT DOCUMENTS

| | | | |
|---|---|---|---|
| EP | 0618380 | B1 | 10/1994 |
| EP | 0750811 | A1 | 9/1995 |
| EP | 0750811 | B1 | 1/1997 |
| EP | 0797324 | A2 | 9/1997 |
| EP | 0797324 | B1 | 9/1997 |
| EP | 1107232 | A2 | 6/2001 |
| EP | 1845519 | A3 * | 11/2007 |

* cited by examiner

AUDIO CODING

This invention relates to the coding of a multi-channel audio signal and, more particularly, to the coding of a multi-channel audio signal which includes at least a first signal component, a second signal component and a third signal component.

Parametric descriptions of audio signals have gained interest during the last years, especially in the field of audio coding. It has been shown that transmitting (quantized) parameters that describe audio signals requires only little transmission capacity and that they allow a decoding at the receiving end which results in an audio signal that perceptually does not significantly differ from the original signal.

European patent application EP 1 107 232; discloses a parametric coding scheme for a stereo signal comprising a left (L) and a right (R) channel signal. The coding scheme generates a representation of the stereo signal which includes information concerning only one of the L and R signals and parametric information based on which, together with the above information concerning one of the L and R signals, the other signal can be recovered.

However, the above prior art document is not concerned with the problem of efficiently coding multi-channel signals which comprise more than two channels.

The above and other problems are solved by a method of encoding a multi-channel audio signal including at least a first signal component, a second signal component and a third signal component, the method comprising:

encoding the first and second signal components by a first parametric encoder resulting in a first encoded signal and a first set of encoding parameters;

encoding the first encoded signal and a further signal by a second parametric encoder, resulting in a second encoded signal and a second set of encoding parameters, where the further signal is derived from at least the third signal component; and representing the multi-channel audio signal at least by a resulting encoded signal derived from at least the second encoded signal, by the first set of encoding parameters and by the second set of encoding parameters.

Hence, by cascading a plurality of parametric coders, such as stereo coders, an efficient coding scheme for multi-channel audio signals is provided. According to the cascading scheme, the output of a first parametric encoding step is fed as an input to a subsequent second encoding step together with a further input signal, e.g. the output of another second parametric encoding step.

Consequently, according to the invention, a multi-channel signal with n>2 audio channels may be encoded as a single encoded signal channel and a number of encoding parameter bit streams corresponding to the parametric encoders, thereby providing a high coding efficiency.

In a preferred embodiment, the multi-channel audio signal further comprises a fourth signal component; the method further comprises encoding the third and fourth signal components by a third parametric encoder resulting in the further signal and a third set of encoding parameters; and the step of representing the multi-channel audio signal comprises the step of representing the multi-channel audio signal at least by the resulting encoded signal derived from at least the second encoded signal, by the first set of encoding parameters, by the second set of encoding parameters, and by the third set of encoding parameters. Hence, the further input signal to the second parametric encoder is also an output of a previous encoder.

The term parametric encoder refers to an encoder for encoding at least two audio channels resulting in a single encoded audio channel and a set of encoding parameters that allow a decoder to decode the encoded audio channel into two decoded audio channels. Examples of such parametric coding schemes comprise a coding of a stereo signal as a principal component signal and a corresponding rotation angle, a coding of a stereo signal into a combination signal and a number of parameters corresponding to the spatial attributes of the stereo signal, etc. However, any known suitable parametric encoding scheme may be used. The first and second parametric encoding modules may implement the same or different parametric encoding schemes.

The resulting encoded signal may be derived from the second encoded signal alone, i.e. it may be identical to or a result of a transformation of the second encoded signal. Alternatively, the resulting encoded signal may be derived from a combination of the second encoded signal and another signal. For example, the second encoded signal may serve as an input to a further encoding module corresponding to a further cascading stage.

Within the field of audio coding, the coding of four-channel signals comprising a left-front channel, a left-rear channel, a right-front channel, and a right-rear channel, are particularly relevant. According to the invention, such a signal may be efficiently encoded by a cascaded chain of three parametric encoders: A first encoder encodes the left-front and the left-rear channel resulting in a combined left channel and the corresponding encoding parameters. A second encoder encodes the right-front and the right-rear channel resulting in a combined right channel and the corresponding encoding parameters. The third encoder receives the combined right channel and the combined left channel and generates a single encoded signal and a corresponding third set of encoding parameters.

Furthermore, the emerging technologies of Digital Versatile Disc (DVD) and Super Audio Compact Disc (SACD) comprise five audio channels: The four channels mentioned above and an additional center channel. According to the invention, such a signal may efficiently be encoded by using four parametric encoders: Three encoders encode the left and right channels as in the case of a four-channel case above, and the fourth encoder receives the output signal of the above cascaded chain and the center signal as inputs and generates a final encoded signal.

In another preferred embodiment, the multi-channel signal comprises a five-channel audio signal, the first signal component includes a left-front channel of the five-channel audio signal, the second signal component includes a left-rear channel of the five-channel audio signal, the third signal component includes a right-front channel of the five-channel audio signal; the fourth signal component includes a right-rear channel of the five-channel audio signal; the five-channel audio signal further includes a center signal; and the step of encoding the first encoded signal and a further signal further comprises combining each of the first encoded signal and the further signal with the center signal. Hence, according to this embodiment, the center signal is combined with the encoded left channel and with the encoded right channel, before encoding the left and right channel as a final encoded signal.

It is a further advantage of this embodiment that it provides an efficient encoding of a five-channel signal with only three stereo encoders.

It is a further advantage of the invention that it provides a coding scheme which allows a decoder at the receiving end to adapt to the number of reproduction channels that are available at the receiving end.

The present invention can be implemented in different ways including the method described above and in the following, arrangements for encoding and decoding, and further product means, each yielding one or more of the benefits and advantages described in connection with the first-mentioned method, and each having one or more preferred embodiments corresponding to the preferred embodiments described in connection with the first-mentioned method and disclosed in the dependant claims.

It is noted that the features of the method described above and in the following may be implemented in software and carried out in a data processing system or other processing means caused by the execution of computer-executable instructions. The instructions may be program code means loaded in a memory, such as a RAM, from a storage medium or from another computer via a computer network. Alternatively, the described features may be implemented by hard-wired circuitry instead of software or in combination with software.

The invention further relates to a method of decoding an encoded multi-channel audio signal, the method comprising:

obtaining a first encoded signal, a first set of encoding parameters, and a second set of encoding parameters from the encoded multi-channel audio signal;

obtaining first and second decoded signals from the first encoded signal and the first set of encoding parameters, the second decoded signal representing at least a first signal component of the multi-channel signal; and obtaining third and fourth decoded signals from the first decoded signal and the second set of encoding parameters.

The invention further relates to an arrangement for encoding a multi-channel audio signal including at least a first signal component, a second signal component and a third signal component, the arrangement comprising:

a first parametric encoder adapted to encode the first and second signal components resulting in a first encoded signal and a first set of encoding parameters;

a second parametric encoder adapted to encode the first encoded signal and a further signal, resulting in a second encoded signal and a second set of encoding parameters, where the further signal is derived from at least the third signal component.

The invention further relates to an arrangement for decoding an encoded multi-channel audio signal, the arrangement comprising:

means for obtaining a first encoded signal, a first set of encoding parameters, and a second set of encoding parameters from the encoded multi-channel audio signal;

a first decoder adapted to obtain first and second decoded signals from the first encoded signal and the first set of encoding parameters, the second decoded signal representing at least a first signal component of the multi-channel signal; and a second decoder adapted to obtain third and fourth decoded signals from the first decoded signal and the second set of encoding parameters.

The invention further relates to an apparatus for supplying an encoded audio signal, the apparatus comprising a unit for receiving a multi-channel audio signal;

an arrangement for encoding as described above and in the following for encoding the multi-channel audio signal; and an output unit for providing the encoded audio signal.

The invention further relates to an apparatus for supplying a decoded audio signal, the apparatus comprising an input unit for receiving an encoded audio signal;

an arrangement for decoding as described above and in the following for decoding the encoded audio signal; and an output unit for providing the decoded audio signal.

The invention further relates to an encoded multi-channel audio signal including an audio signal and first and second sets of parameters, where the audio signal and the first set of parameters are generated by a first parametric encoder upon input of a first encoded signal and a further signal, where the first encoded signal and the second set of parameters are generated by a second parametric encoder upon input of a first and second signal component of a multi-channel signal, and where the further signal is derived from at least a third signal component of the multi-channel signal.

The invention further relates to a storage medium having stored thereon such an encoded audio signal.

These and other aspects of the invention will be apparent and elucidated from the embodiments described in the following with reference to the drawing in which.

Figure 6:
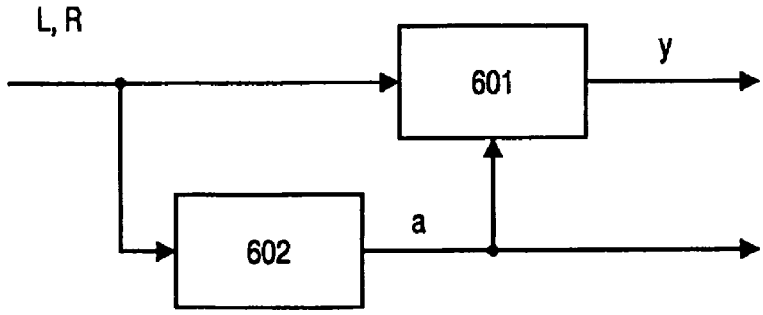
Figure 7:
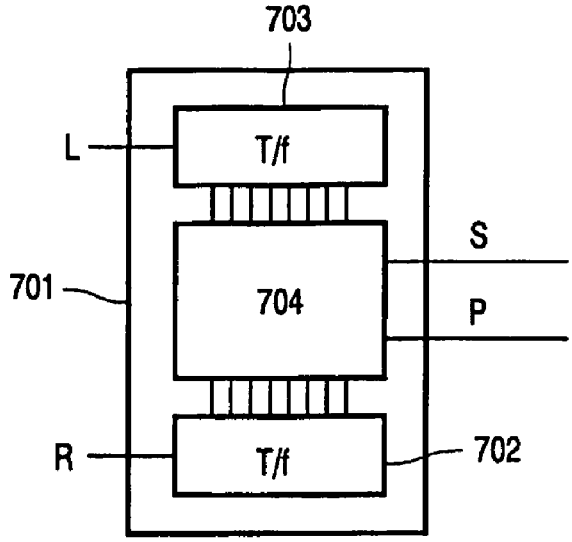
Figure 8:
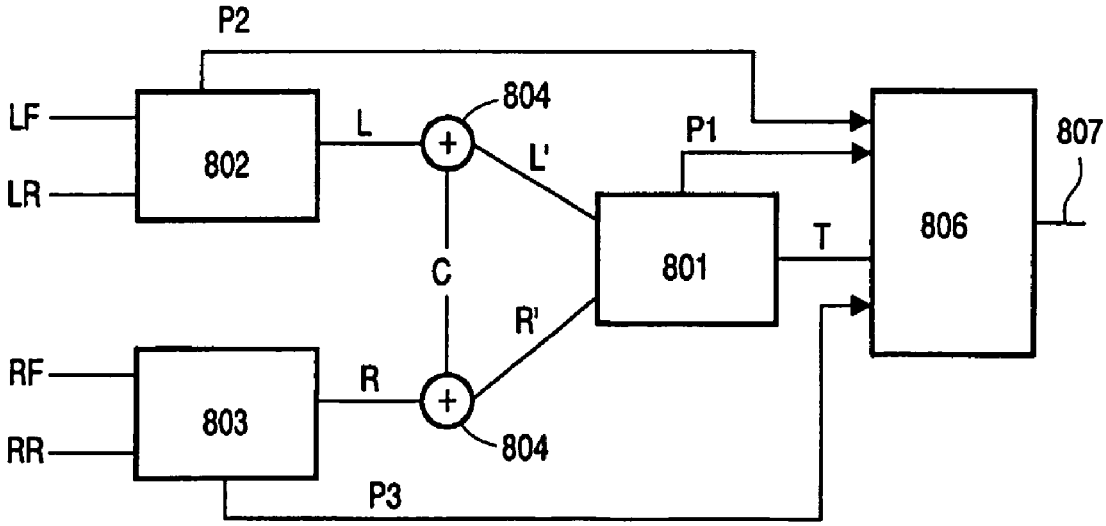
Figure 9:
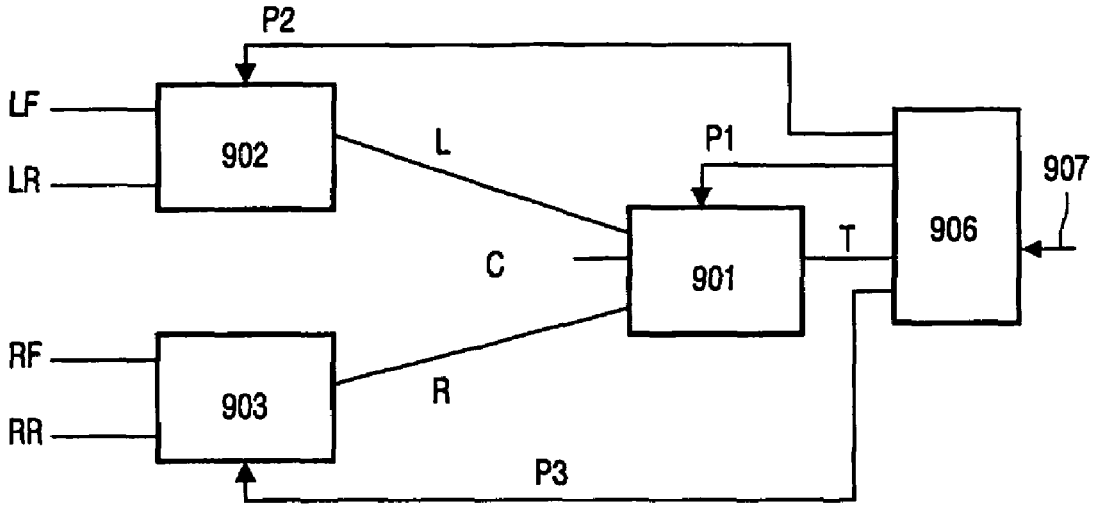
Figure 10:
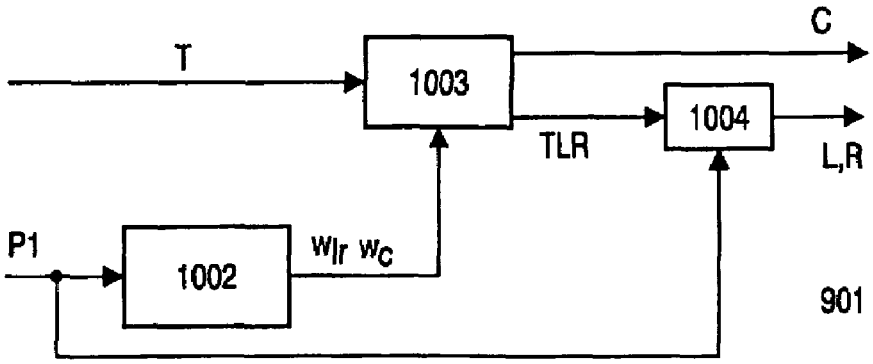

FIG. 6 schematically illustrates a first example of an encoding module;

FIG. 7 schematically illustrates a second example of an encoding module;

FIG. 8 shows a block diagram of an encoder for encoding a five-channel audio signal according to an embodiment of the invention;

FIG. 9 shows a block diagram of a decoder for decoding an encoded five-channel audio signal according to an embodiment of the invention;

FIG. 10 shows a block diagram of the decoder 901 of FIG. 9 according to an embodiment of the invention; and FIG. 11 schematically illustrates examples of functional forms of the three functions used to determine the weighting factors in the embodiment of FIG. 10.

Figure 1:
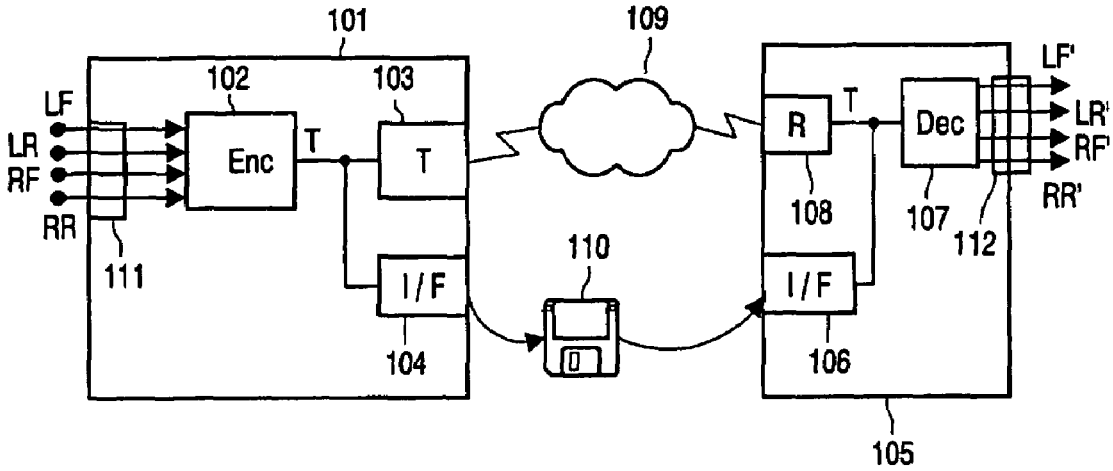
FIG. 1 shows a schematic view of a system for communicating multi-channel audio signals according to an embodiment of the invention.

FIG. 1 shows a schematic view of a system for communicating multi-channel audio signals according to an embodiment of the invention. The system comprises a coding device 101 for generating a coded four-channel signal and a decoding device 105 for decoding a received coded signal into a four-channel signal. The coding device 101 and the decoding device 105 each may be any electronic equipment or part of such equipment.

Here, the term electronic equipment comprises computers, such as stationary and portable PCs, stationary and portable radio communication equipment and other handheld or portable devices, such as mobile telephones, pagers, audio players, multimedia players, communicators, i.e. electronic organizers, smart phones, personal digital assistants (PDAs), handheld computers, or the like. It is noted that the coding device 101 and the decoding device may be combined in one electronic equipment where audio signals are stored on a computer-readable medium for later reproduction.

The coding device 101 comprises an input unit 111 for receiving a multi-channel signal, an encoder 102 for encoding a four-channel audio signal, the four-channel signal including a left-front signal component LF, a left-rear signal component LR, a right-front signal component RF, and a right-rear signal component RR. The encoder 102 receives the four signal components via the input unit 111 and generates a coded signal T. The four-channel signal may originate from a set of microphones, e.g. via further electronic equipment, such as a mixing equipment, etc. The signals may further be received as an output from another audio player, over-the-air as a radio signal, or by any other suitable means. Preferred embodiments of such an encoder according to the invention will be described below.

According to one embodiment, the encoder 102 is connected to a transmitter 103 for transmitting the coded signal T via a communications channel 109 to the decoding device 105. The transmitter 103 may comprise circuitry suitable for enabling the communication of data, e.g. via a wired or a wireless data link 109. Examples of such a transmitter include a network interface, a network card, a radio transmitter, a transmitter for other suitable electromagnetic signals, such as an LED for transmitting infrared light, e.g. via an IrDa port, radio-based communications, e.g. via a Bluetooth transceiver, or the like. Further examples of suitable transmitters include a cable modem, a telephone modem, an Integrated Services Digital Network (ISDN) adapter, a Digital Subscriber Line (DSL) adapter, a satellite transceiver, an Ethernet adapter, or the like. Correspondingly, the communications channel 109 may be any suitable wired or wireless data link, for example of a packet-based communications network, such as the Internet or another TCP/IP network, a short-range communications link, such as an infrared link, a Bluetooth connection or another radio-based link.

Further examples of the communications channel include computer networks and wireless telecommunications networks, such as a Cellular Digital Packet Data (CDPD) network, a Global System for Mobile (GSM) network, a Code Division Multiple Access (CDMA) network, a Time Division Multiple Access Network (TDMA), a General Packet Radio service (GPRS) network, a Third Generation network, such as a UMTS network, or the like.

Alternatively or additionally, the coding device may comprise one or more other interfaces 104 for communicating the coded signal T to the decoding device 105. Examples of such interfaces include a disc drive for storing data on a computer-readable medium 110, e.g. a floppy-disk drive, a read/write CD-ROM drive, a DVD-drive, etc. Other examples include a memory card slot a magnetic card reader/writer, an interface for accessing a smart card, etc.

Correspondingly, the decoding device 105 comprises a corresponding receiver 108 for receiving the signal transmitted by the transmitter and/or another interface 106 for receiving the coded signal communicated via the interface 104 and the computer-readable medium 110. The decoding device further comprises a decoder 107 which receives the received signal T and decodes it into corresponding components LF', LR', RF', and RR' of a decoded four-channel signal. Preferred embodiments of such a decoder according to the invention will be described below. The decoding device further comprises an output unit 112 for outputting the decoded signals which may subsequently be fed into an audio player for reproduction via a set of four speakers, or the like.

Figure 2:
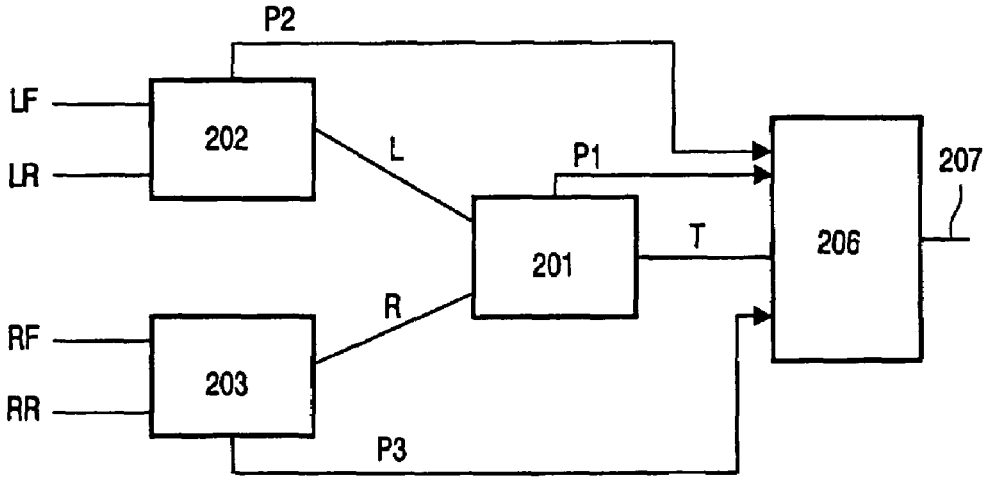
FIG. 2 shows a block diagram of an encoder for encoding a four-channel audio signal according to an embodiment of the invention.

FIG. 2 shows a block diagram of an encoder for encoding a four-channel audio signal according to an embodiment of the invention. The encoder receives a four-channel audio signal as an input, where the four input channels to be encoded are designated left-front (LF), right-front (RF), left-rear (LR), and right-rear (RR), corresponding to the corresponding speakers of a four-channel audio system. The encoder comprises parametric encoding modules 201, 202, and 203. The encoding module 202 forms a single audio channel L from both left-side speaker signals LF and LR combined with a corresponding parameter bit stream P2. Similarly, the encoding module forms a single audio channel R from both right-side speaker signals RF and RR combined with a corresponding parameter bit stream P3.

Subsequently, the encoding module 201 generates one broadband audio signal T from the total-left and total-right signals L and R, respectively. Furthermore, this merging process results in a third parameter bit stream P1 that describes the spatial properties between the total-left and total-right channels.

The encoder further comprises a combiner circuit 206 performing a proper encoding of the signal T, for example according to MPEG, e.g. MPEG I layer 3 (MP3), according to sinusoidal coding (SSC), or another suitable coding scheme or a combination thereof. The combiner circuit 206 further performs framing, bit-rate allocation, and lossless coding, resulting in a combined signal 207 to be communicated. Alternatively, the combiner circuit 206 may supply the audio signal T and the bit streams as two or more separate signals, as a multiplexed signal, or the like.

Hence, the encoder of FIG. 2 generates an output signal including one broadband audio signal T and three parameter bit streams P1, P2, and P3 to be communicated to a receiver and/or stored on a storage medium and/or the like. It is noted that, even though the example FIG. 2 uses 4 audio channels, a similar approach can be used using a different number of audio channels.

Figure 3:
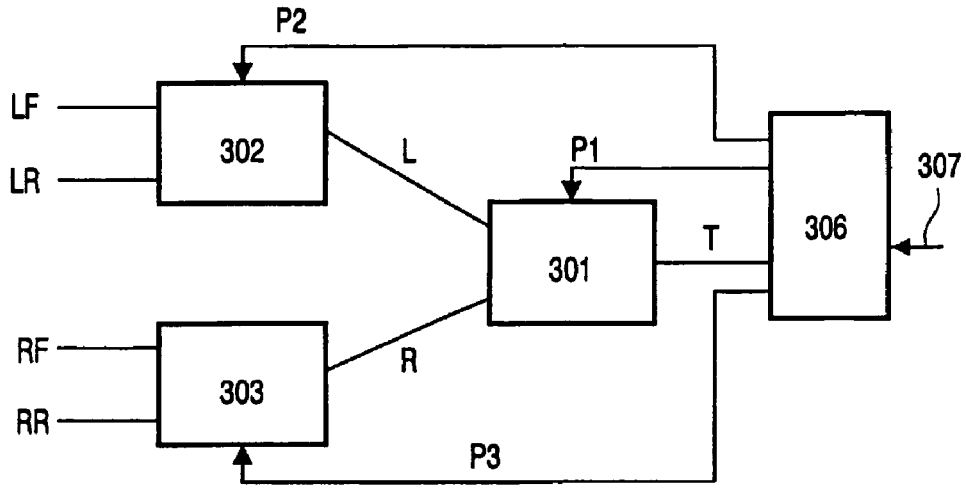
FIG. 3 shows a block diagram of a decoder for decoding an encoded four-channel audio signal according to an embodiment of the invention.

It is understood that, alternatively, the encoder 202 may encode the signals LR and RR to generate a total rear signal while the encoder 203 may encode the signals LF and RF to generate a total front signal. Subsequently, the total front and total rear signals are combined by a further encoder. The parameters generated by that encoder may then be used for a 2D parameter representation, i.e. the parameters from this encoder may be used as overall parameters to decode front from rear channels for both left and right channels. FIG. 3 shows a block diagram of a decoder for decoding an encoded four-channel audio signal according to an embodiment of the invention. The decoder comprises a circuit 306 for extracting the encoded signal T and the parameter streams P1, P2, and P3 from the received signal 307, i.e. the circuit 306 performs an inverse operation of the combiner 206 of FIG. 2.

The decoder further comprises parametric decoding modules 301, 302, and 303 corresponding to the encoding modules 201, 202, and 203, respectively. The cascaded encoding process described in connection with FIG. 2 is reversed in the decoder: The decoder receives a broadband audio signal T and three parameter bit streams P1, P2, and P3. First, the decoding module 301 synthesizes the total-left and total-right signals L and R, respectively, from the single incoming audio signal T using the appropriate parameters P1. If the current end-user has only two loudspeakers, the decoding process ends here.

If the end-user has 4 loudspeakers, an additional decoding step is performed:

Decoder 302 receives the total-left signal L and the parameter bit stream P2 and synthesizes from it the left-front and left-rear signals LF and LR, respectively.

Similarly, decoder 303 receives the total-right signal R and the parameter bit stream P3 and synthesizes from it the right-front and right-rear signals RF and RR, respectively.

In one embodiment, the same parameters may be used for decoder 302 and 303, thereby further reducing the bandwidth required for transmitting the multi-channel signal, as only one of the parameter bit streams P2 and P3 (or a combination thereof) needs to be transmitted from the encoder to the decoder. In this embodiment, the parameters P1 that are fed into decoder 301 determine the left-right spatial sound image, while the parameters that enter decoder 302 and 303 determine the front-back spatial image.

Figure 4:
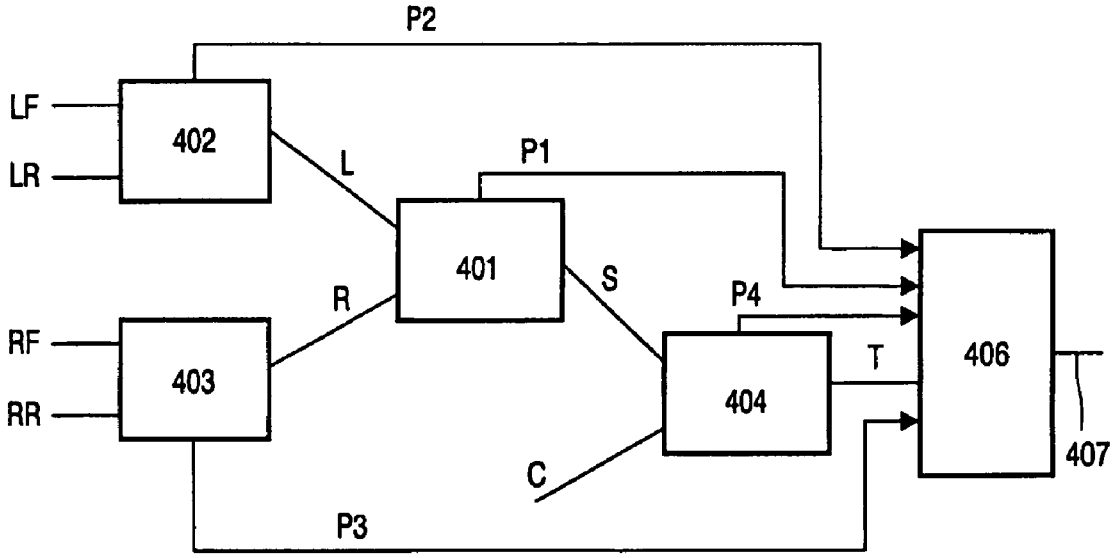
FIG. 4 shows a block diagram of an encoder for encoding a five-channel audio signal according to an embodiment of the invention.

FIG. 4 shows a block diagram of an encoder for encoding a five-channel audio signal according to an embodiment of the invention. The encoder comprises encoding modules 401, 402, 403, and 404. The encoder receives a five-channel audio signal as an input, where the five input channels to be encoded are designated left-front (LF), right-front (RF), left-rear (LR), right-rear (RR), and center (C), corresponding to the corresponding speakers of a five-channel audio system.

The encoding modules 402 and 403 generate the total-left and total-right signals L and R, respectively, and corresponding bit streams P2 and P3, respectively, from the corresponding input signals LF, LR and RF, RR, respectively.

Subsequently, the encoding module 401 generates an audio signal S and corresponding bit stream PI from the total-left and total-right signals L and R, respectively. Hence, the encoding modules 401, 402, and 403 correspond to the encoding modules 201, 202, and 203 of FIG. 2.

The encoder of FIG. 4 includes an additional cascading stage comprising the encoding module 404 which receives the output signal S of encoder 401 and the center signal C. The encoding module 404 generates a broadband audio signal T and a parameter bit stream representing the mid-side characteristic of the audio signal.

The encoder further comprises a combiner circuit 406 generating an output signal 407, as described in connection with circuit 206 in FIG. 2. Hence, the encoder of FIG. 4 generates an output signal 407 including one broadband audio signal T and four parameter bit streams P1, P2, P3, and P4 to be communicated to a receiver and/or stored on a storage medium and/or the like.

Figure 5:
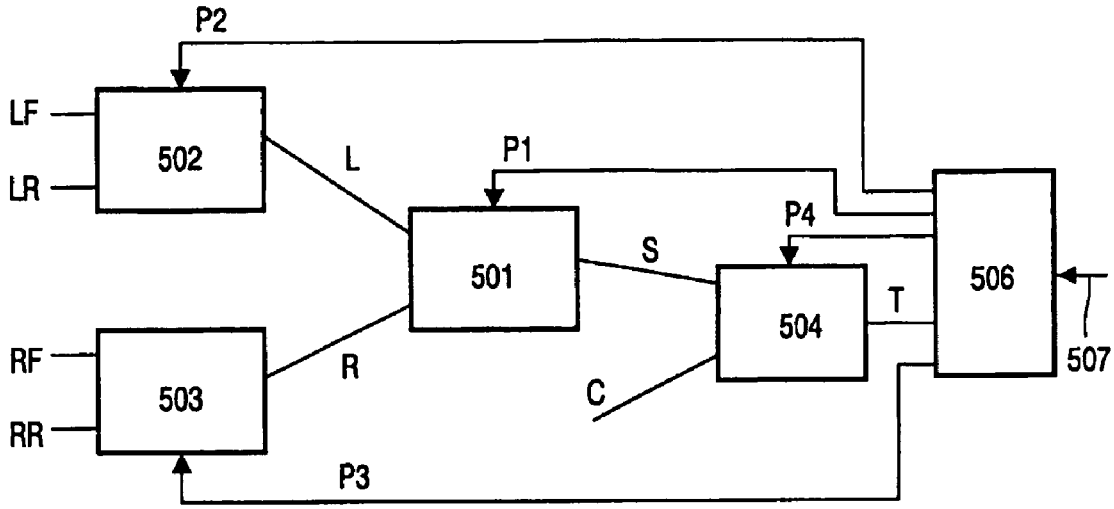
FIG. 5 shows a block diagram of a decoder for decoding an encoded five-channel audio signal according to an embodiment of the invention.

FIG. 5 shows a block diagram of a decoder for decoding an encoded five-channel audio signal according to an embodiment of the invention. The decoder comprises a circuit 506 for extracting the encoded signal T and the parameter streams P1, P2, P3, and P4 from the received signal 507, i.e. the circuit 506 performs an inverse operation of the combiner 406 of FIG. 4.

The decoder further comprises parametric decoding modules 501, 502, 503, and 504 corresponding to the encoding modules 401, 402, 403, and 404, respectively, the cascaded encoding process described in connection with FIG. 4 is reversed in the decoder: The decoder receives a broadband audio signal T and three parameter bit streams P1, P2, P3, and P4. First, the decoding module 504 synthesizes the total side signal S and the side signal C using the parameters P4.

Subsequently, the decoders 501, 502, and 503 synthesize the left-front, left-rear, right-front, and right-rear signals LF, LR, RF, and RR, respectively, from the total side signal S and the parameter bit streams P1, P2, and P3, as was described in connection with the decoder of FIG. 3.

It is understood that, alternatively, a five-channel audio transmission may be achieved by transmitting two audio channels combined with three parameter bit streams, e.g. by transmitting an encoded four-channel signal as described in connection with FIGS. 2 and 3 and one additional mono channel.

FIG. 6 schematically illustrates a first example of a parametric encoding module. The arrangement receives an audio signal having two signal components L and R. For example, these signal components may be two of the incoming signal components of a multi-channel signal, such as the LF and LR signal components or the RF and RR signal components of a four channel signal, or the encoded total-left and total-right signals generated by the encoders 402 and 403, respectively, in FIG. 4. The parametric encoding module comprises circuitry 601 for performing a rotation of the incoming signal in the L-R space by an angle $\alpha$, resulting in rotated signal components y and r according to the transformation $$y=L\cos\alpha+R\sin\alpha=w_L L+w_R R$$

$$r=-L\sin\alpha+R\cos\alpha=-w_R L+w_L R,$$

where $w_L=\cos\alpha$ and $w_R=\sin\alpha$ will be referred to as weighting factors.

Preferably, the angle $\alpha$ is determined such that it corresponds to a direction of high signal variance. The direction of maximum signal variance, i.e. the principal component, may be estimated by a principal component analysis such that the rotated y component corresponds to the principal component signal which includes most of the signal energy, and r is a residual signal. Correspondingly, the encoding module of FIG. 6 further comprises circuitry 602 which determines the angle $\alpha$ or, alternatively, the weighting factors $w_L$ and $w_R$, for example by performing a principle component analysis (PCA) of the incoming signal samples.

In one embodiment, the encoding module of FIG. 6 outputs the principle component signal y and the rotation parameter $\alpha$ or one of $w_L$ and $w_R$. In another embodiment, the parametric encoder may determine filter parameters of an adaptive linear filter such that the adaptive filter generates an estimate of the residual signal r when the principle component signal y is fed into the filter as an input. According to this embodiment, the incoming signal is encoded as the principle component signal y, a rotation parameter, and a set of filter parameters, thereby allowing a decoder at the receiver to predict the residual signal r from the received principle component signal y, and to rotate the signal back into the L and R direction (see e.g. European patent application nr. 02076410.6, filed on 10 Apr. 2002).

FIG. 7 schematically illustrates a second example of an encoding module. The encoding module of FIG. 7 describes the spatial attributes of a multi-channel audio signal by specifying an interaural level difference, an interaural time (or phase) difference, and a maximum correlation as a function of time and frequency, as is described in European patent application no. 02076588.9, filed on 22 Apr. 2002. The encoding module receives the L and R components of a stereo signal as inputs. Initially, by time/frequency slicing circuits 702 and 703, the R and L components, respectively, are split up into several time/frequency slots, e.g. by time-windowing followed by a transform operation.

Subsequently, in the analysis circuit 704, for every time/frequency slot, the following properties of the incoming signals are analyzed:

The interaural level difference, or ILD, defined by the relative levels of the corresponding band-limited signals stemming from the two inputs, The interaural time (or phase) difference (ITD or IPD), defined by the interaural delay (or phase shift) corresponding to the peak in the interaural cross-correlation function, and The (dis)similarity of the waveforms that can not be accounted for by ITDs or ILDs, which can be parameterized by the maximum value of the cross-correlation function (i.e., the value of the cross-correlation function at the position of the maximum peak).

The three parameters described above vary over time; however, since it is known that the binaural auditory system is very sluggish in its processing, the update rate of these properties is rather low (typically tens of milliseconds).

The analysis circuit 704 further generates a sum (or dominant) signal S comprising a combination of the left and right signals. Hence, the L and R signals are encoded as the sum signal S and a set of parameters P as a function of frequency and time, the parameters P comprising the ILD, the ITD/IPD, and the maximum value of the cross-correlation function.

FIG. 8 shows a block diagram of an encoder for encoding a five-channel audio signal according to an embodiment of the invention. The encoder comprises encoding modules 801, 802, and 803. The encoder receives a five-channel audio signal as an input, where the five input channels to be encoded are designated left-front (LF), right-front (RF), left-rear (LR), right-rear (RR), and side (C), corresponding to the corresponding speakers of a five-channel audio system.

The encoding modules 802 and 803 generate the total-left and total-right signals L and R, respectively, and corresponding bit streams P2 and P3, respectively, from the corresponding input signals LF, LR and RF, RR, respectively.

Subsequently, the encoding module 801 generates an audio signal T and corresponding bit stream P1 from the total-left and total-right signals received from the encoding modules 802 and 803, respectively. Hence, the encoding modules 801, 802, and 803 correspond to the encoding modules 201, 202, and 203 of FIG. 2.

However, in contrast to the previous embodiment, the side signal C is combined with both the total-left and total-right signals L and R generated by the encoders 802 and 803, respectively. The encoder of FIG. 8 comprises summing circuits 804 for adding the side signal to each of the total-left and total-right signals L and R, resulting in combined signals L' and R', respectively which are fed into the encoding module 801. The encoder further comprises a combiner circuit 806 for generating the final output signal 807 as described in connection with circuit 206 in FIG. 2.

It is an advantage of this embodiment that it provides a more cost-effective method to code five-channel audio.

FIG. 9 shows a block diagram of a decoder for decoding an encoded five-channel audio signal according to an embodiment of the invention. The decoder of FIG. 9 is suitable for decoding a signal encoded by the encoder of FIG. 8. The decoder comprises a circuit 906 for extracting the encoded signal T and the parameter streams P1, P2, and P3 from the received signal 907, i.e. the circuit 906 performs an inverse operation of the combiner 806 of FIG. 8.

The decoder further comprises decoding modules 901, 902, and 903. The encoding module 901 receives the encoded audio signal T and the corresponding set of parameters P1. Initially, the decoding module 901 analyses the transmitted parameters P1. If the parameters P1 indicate that the signal is a mono signal, the decoder outputs the received signal as a side signal. Hence, in this case, the signal is fed to a side speaker and no signal is fed to the left and right channel outputs L and R of decoder 901.

If the transmitted parameters P1 indicate that the signal is stereo, the signal is decoded in by distributing the signal to the left and right outputs.

The method used for detecting mono or stereo content depends on the exact coder structure and parameter bit stream. For example, in one embodiment using the parametric encoding of spatial stereo described in connection with FIG. 7, the ITD, ILD and correlation parameters determine the spatial signal properties as a function of frequency. Hence, for each frequency band, the corresponding band-limited signal is fed to the center speaker, if the ITD and ILD are close to zero, e.g. smaller than a predetermined constant, and if the correlation is close to +1, i.e. if the difference of 1 minus the correlation is smaller than a predetermined constant, e.g. smaller than 0.1. For example, the predetermined constant for the ITD may be chosen to be of the order of 50-100 microseconds, and for the ILD the predetermined constant may be chosen e.g. 1 to 3 dB. For all other values of the parameters, the signal is distributed over the left and right outputs. A preferred embodiment of an encoding module 901 will be described in connection with FIG. 10.

The decoding modules 902 and 903 decode the total-right and total-left signals as described above, resulting in the left-front, left-rear, right-front, and right-rear signal components LF, LR, RF, and RR, respectively.

FIG. 10 shows a block diagram of the decoder 901 of FIG. 9 according to an embodiment of the invention. The encoding module 901 receives the encoded audio signal T and the corresponding set of parameters P1. The general idea behind the decoding module 901 is to feed (a specific frequency band of) the input signal to the center speaker only if the spatial parameters indicate that the output signals are mono (which means ILD=0, ITD=0, correlation=+1). For other values of the spatial parameters, the signal should be sent to the left and right outputs using the parametric decoder.

However, it is more desirable to achieve a smooth transition between a distribution to the center output and the left and right outputs depending on the spatial parameters. Consequently, the decoding module comprises circuitry 1002 which receives the parameters P1 and computes weighting functions $w_c$ and $w_{lr}$. Here, $w_c$ denotes the relative amount of the mono input signal that is to be sent to the center output, while $w_{lr}$ denotes the relative amount of the input signal that is to be decoded according to the spatial parameters and sent to the left and right output pair. In one embodiment, the relation between the weights is set by the following constraint:

$$w_c^n + w_{lr}^n = 1$$

Here, n denotes a power which indicates whether the system should preserve the overall amplitude (n=1), preserve the total amount of power (n=2) or any other overall signal level measure. Hence if $w_c$ is known, $w_{lr}$ can be obtained according to the above equation and vice versa.

The decoding module further comprises circuitry 1003 which divides each subband of the input signal according to the weight factors $w_c$ and $w_{lr}$ between the center output C and the input $T_{LR}$ to a parametric decoder 1004. The parametric decoder decodes the scaled signal $T_{LR}$ as described above, resulting in the total-left and the total-right signals L and R, respectively.

Preferably, the circuitry 1002 determines the weight $w_c$ such that $w_c=1$, if the ILD and ITD of a certain subband equal 0 and if the correlation equals +1. For other values of the parameters, $w_c$ should decrease towards zero. In one embodiment, this behavior is obtained in the following way: $w_c$ is composed of the product of three functions $P_1$, $P_2$, and $P_3$. $P_1$ only depends on the ILD value of that subband, $P_2$ only depends on the ITD value of the current subband, and $P_3$ only depends on the cross-correlation of that subband. Thus:

$$w_c = P_1(ILD) \cdot P_2(ITD) \cdot P_3(\rho)$$

Figure 11A:
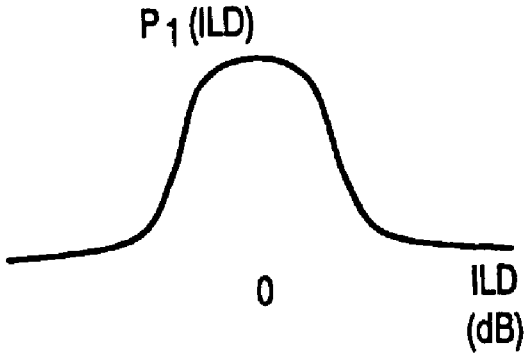
Figure 11B:
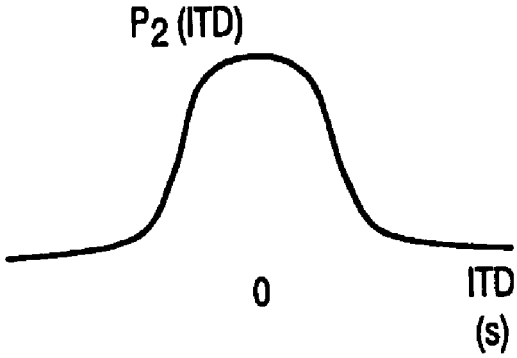
Figure 11C:
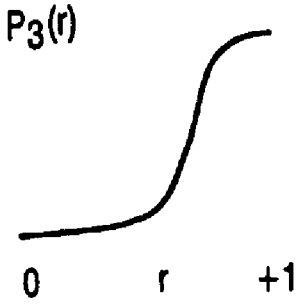

FIGS. 11*a-c* schematically illustrate examples of functional forms of the three functions used to determine the weighting factors in the embodiment of FIG. 10.

Preferably, the functional form of the functions $P_1$, $P_2$, and $P_3$ should meet the following constraints: $P_1$ and $P_2$ have a maximum of +1 for an ILD (respectively ITD) of zero and decrease towards zero for smaller or larger values. $P_3$ has a maximum of +1 at correlation +1 and decreases towards zero for lower values. FIGS. 11*a-c* illustrate examples of functions $P_1$, $P_2$, and $P_3$, respectively, which fulfill the above conditions.

It is noted that alternative methods for distributing the decoded signal T between the center output C, the left output L, and the right output R may be used. For example, initially, the signal T may be decoded into an L and an R signal using the parameters P1, as described above. Subsequently, an algorithm to redistribute two input signals over three (left, center, right) outputs may be employed. Hence first the left and right output signals of the decoder are computed using any known parametric stereo decoder, followed by a redistribution (matrixing) of signals to the three (left, right and center) outputs. Such methods are known in the art of 2-to-5 channel processors, as described in international patent application WO 02/07481.

It is noted that the above arrangements may be implemented as general- or special-purpose programmable microprocessors, Digital Signal Processors (DSP), Application Specific Integrated Circuits (ASIC), Programmable Logic Arrays (PLA), Field Programmable Gate Arrays (FPGA), special purpose electronic circuits, etc., or a combination thereof.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements.

The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A method of encoding a multi-channel audio signal including at least a first signal component, a second signal component and a third signal component, the method comprising:

encoding the first and second signal components by a first parametric encoder resulting in a first encoded signal and a first set of encoding parameters;

encoding the first encoded signal and a further signal by a second parametric encoder, resulting in a second encoded signal and a second set of encoding parameters, where the further signal is derived from at least the third signal component; and representing the multi-channel audio signal at least by a resulting encoded signal derived from at least the second encoded signal, by the first set of encoding parameters and by the second set of encoding parameters.

2. A method according to claim 1, wherein the multi-channel audio signal further comprises a fourth signal component; the method further comprises encoding the third and fourth signal components by a third parametric encoder resulting in the further signal and a third set of encoding parameters; and the step of representing the multi-channel audio signal comprises the step of representing the multi-channel audio signal at least by the resulting encoded signal derived from at least the second encoded signal, by the first set of encoding parameters, by the second set of encoding parameters, and by the third set of encoding parameters.

3. A method according to claim 2, wherein the multi-channel signal comprises a four-channel audio signal, the first signal component includes a left-front channel of the four-channel audio signal, the second signal component includes a left-rear channel of the four-channel audio signal, the third signal component includes a right-front channel of the four-channel audio signal, and the fourth signal component includes a right-rear channel of the four-channel audio signal.

4. A method according to claim 2, wherein the multi-channel signal comprises a five-channel audio signal, the first signal component includes a left-front channel of the five-channel audio signal, the second signal component includes a left-rear channel of the five-channel audio signal, the third signal component includes a right-front channel of the five-channel audio signal, the fourth signal component includes a right-rear channel of the five-channel audio signal; the five-channel audio signal further includes a center signal; the method further comprises encoding the second encoded signal and the center signal by a fourth parametric encoder resulting in a third encoded signal and a fourth set of encoding parameters; and the step of representing the multi-channel audio signal comprises representing the multi-channel audio signal at least by the third encoded signal, and by the first, second, third and fourth sets of encoding parameters.

5. A method according to claim 2, wherein the multi-channel signal comprises a five-channel audio signal, the first signal component includes a left-front channel of the five-channel audio signal, the second signal component includes a left-rear channel of the five-channel audio signal, the third signal component includes a right-front channel of the five-channel audio signal; the fourth signal component includes a right-rear channel of the five-channel audio signal; the five-channel audio signal further includes a center signal; and the step of encoding the first encoded signal and a further signal further comprises combining each of the first encoded signal and the further signal with the center signal.

6. A method according to claim 2, wherein the multi-channel signal comprises a five-channel audio signal, the first signal component includes a left-front channel of the five-channel audio signal, the second signal component includes a left-rear channel of the five-channel audio signal, the third signal component includes a right-front channel of the five-channel audio signal, the fourth signal component includes a right-rear channel of the five-channel audio signal; the five-channel audio signal further includes a center signal; and the step of representing the multi-channel audio signal comprises the step of representing the multi-channel audio signal at least by the second encoded signal, the center signal, and by the first, second, and third sets of encoding parameters.

7. A method of decoding an encoded multi-channel audio signal, the method comprising:

obtaining a first encoded signal, a first set of encoding parameters, and a second set of encoding parameters from the encoded multi-channel audio signal;

obtaining first and second decoded signals from the first encoded signal and the first set of encoding parameters, the second decoded signal representing at least a first signal component of the multi-channel signal; and obtaining third and fourth decoded signals from the first decoded signal and the second set of encoding parameters.

8. An arrangement for encoding a multi-channel audio signal including at least a first signal component, a second signal component and a third signal component, the arrangement comprising:

a first parametric encoder adapted to encode the first and second signal components resulting in a first encoded signal and a first set of encoding parameters;

a second parametric encoder adapted to encode the first encoded signal and a further signal, resulting in a second encoded signal and a second set of encoding parameters, where the further signal is derived from at least the third signal component.

9. An arrangement according to claim 8, further comprising means for representing the multi-channel audio signal at least by a resulting encoded signal derived from at least the second encoded signal, by the first set of encoding parameters and by the second set of encoding parameters.

10. An apparatus for supplying an encoded audio signal, the apparatus comprising a unit for receiving a multi-channel audio signal;

an arrangement for encoding as claimed in claim 8 for encoding the multi-channel audio signal; and an output unit for providing the encoded audio signal.

11. An arrangement for decoding an encoded multi-channel audio signal, the arrangement comprising:

means for obtaining a first encoded signal, a first set of encoding parameters, and a second set of encoding parameters from the encoded multi-channel audio signal;

a first decoder adapted to obtain first and second decoded signals from the first encoded signal and the first set of encoding parameters, the second decoded signal representing at least a first signal component of the multi-channel signal; and a second decoder adapted to obtain third and fourth decoded signals from the first decoded signal and the second set of encoding parameters.

12. An apparatus for supplying a decoded audio signal, the apparatus comprising an input unit for receiving an encoded audio signal;

an arrangement for decoding as claimed in claim 11 for decoding the encoded audio signal; and an output unit for providing the decoded audio signal.

13. A storage medium having stored thereon:

an encoded multi-channel audio signal including an audio signal and first and second sets of parameters, where the audio signal and the first set of parameters are generated by a first parametric encoder upon input of a first encoded signal;

and a further signal, where the first encoded signal and the second set of parameters are generated by a second parametric encoder upon input of a first and second signal component of a multi-channel signal, and where the further signal is derived from at least a third signal component of the multi-channel signal.

* * * * *